US007918672B1

(12) United States Patent
Yang

(10) Patent No.: US 7,918,672 B1
(45) Date of Patent: Apr. 5, 2011

(54) BATTERY CONNECTOR

(75) Inventor: Chih-Lin Yang, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/838,378

(22) Filed: Jul. 16, 2010

(51) Int. Cl.
*H01R 12/00* (2006.01)

(52) U.S. Cl. ..... 439/79; 439/567

(58) Field of Classification Search ..... 439/79, 439/80, 567, 500, 569, 573
See application file for complete search history.

(56) References Cited

U.S. PATENT DOCUMENTS 6,354,870 B1 * 3/2002 Timmerman ..... 439/569
6,383,010 B1 * 5/2002 Mayo et al. ..... 439/357
6,659,796 B1 * 12/2003 Waddell et al. ..... 439/557
7,104,838 B1 * 9/2006 Northey ..... 439/566
7,226,315 B2 * 6/2007 Takeda et al. ..... 439/607.04
7,611,381 B2 * 11/2009 Lei ..... 439/567
7,625,235 B2 * 12/2009 Wu et al. ..... 439/607.35
2009/0130870 A1 * 5/2009 Wu et al. ..... 439/83
2010/0136807 A1 * 6/2010 Appel et al. ..... 439/83
* cited by examiner

*Primary Examiner* — Neil Abrams
*Assistant Examiner* — Phuongchi T Nguyen
(74) *Attorney, Agent, or Firm* — Cheng-Ju Chiang

(57) ABSTRACT

A battery connector has an insulating housing, a plurality of terminals mounted to the insulating housing, and a supporting member fixing the insulating housing on the PCB. The insulating housing has a rectangular base, a recess formed at a rear of the base for receiving the supporting member. The recess has a first recess and a pair of second recesses extended downward from two opposite ends of the first recess. The supporting member has a horizontal beam accommodated in the first recess, a pair of connecting slices extended downwards from ends of the horizontal beam and accommodated in the second recesses, a pair of fixing slices extended downward from a bottom of each connecting slice. Free ends of the fixing slices are protruded opposite to each other to form protrusions inserted into the PCB for fixing the battery connector firmly on the printed circuit board.

4 Claims, 5 Drawing Sheets

BATTERY CONNECTOR

BACKGROUND OF THE INVENTION

1. Field of the Invention

The present invention relates to a battery connector, and particularly to a battery connector capable of being fixed on a printed circuit board firmly.

2. The Related Art

Electronic products, such as notebooks and cameras, are used widely. The electronic product is equipped with a charging device including an electric board and a battery connector. A battery is inserted into the electronic product to connect with the battery connector for charging power.

FIG. 5 shows a conventional battery connector 2. The battery connector 2 has an insulating housing 22 fixed on a printed circuit board 24, and a plurality of terminals 23 mounted into the insulating housing 22. The terminal 23 of strip shape has a connecting slice 26 and a soldering slice 27. The contacting slice 26 has a free end of substantially inverted-V shape with an apex thereof stretching out of the insulating housing 22 to contact with a battery 25. The other end of the terminal 23 is vertically fixed on the soldering slice 27. The soldering slice 27 is horizontally fixed on the printed circuit board 24. However, since the battery connector 2 is fixed on the printed circuit board 24 only by the soldering slice 27 being soldered on the printed circuit board 24, there is no horizontal holding force between the battery connector 2 and the printed circuit board 24. As a result, when the battery 25 horizontally pushes against the terminal 23, a relative horizontal displacement is liable to occur between the battery connector 2 and the printed circuit board 24. Consequently, the soldering slice 27 may be loosened from the printed circuit board 24.

Another example of the battery connector is improved from the one described above. In this case, the soldering slice is inserted into a hole of the printed circuit board to have a firm connection. However, the terminals may be out of shape if the pressing force is too large.

SUMMARY OF THE INVENTION

Accordingly, an object of the present invention is to provide a battery connector fixed on a printed circuit board. The battery connector has an insulating housing. The insulating housing has a rectangular base. A lateral side of the base is extended downward to form a fixing plate inserted into the printed circuit board for preventing the battery connector from moving levelly with respect to the printed circuit board, a recess formed at a rear of the base has a horizontal first recess and a pair of second recesses extended downward from two opposite ends of the first recess. A plurality of terminals is mounted into the insulating housing. A supporting member received in the recess of the insulating housing has a horizontal beam accommodated in the first recess, a pair of connecting slices extended downwards from two opposite ends of the horizontal beam and accommodated in the corresponding second recess, a pair of fixing slices extended downward from a bottom of the connecting slice, free ends of the fixing slices protruded opposite to each other to form protrusions inserted into the printed circuit board for preventing the battery connector from moving upward with respect to the printed circuit board.

As described above, the supporting member is of substantially inverted-U shape. The horizontal beam and the connecting slice are respectively accommodated in the first recess and the second recesses, and the inserting slices are inserted into the fixing grooves for fixing the supporting member into the recess of the insulating housing. The fixing slice is inserted into the printed circuit board for fixing the battery connector on the printed circuit board. As a result, the supporting member wrapping the insulating housing is capable of fixing the battery connector firmly on the printed circuit board.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
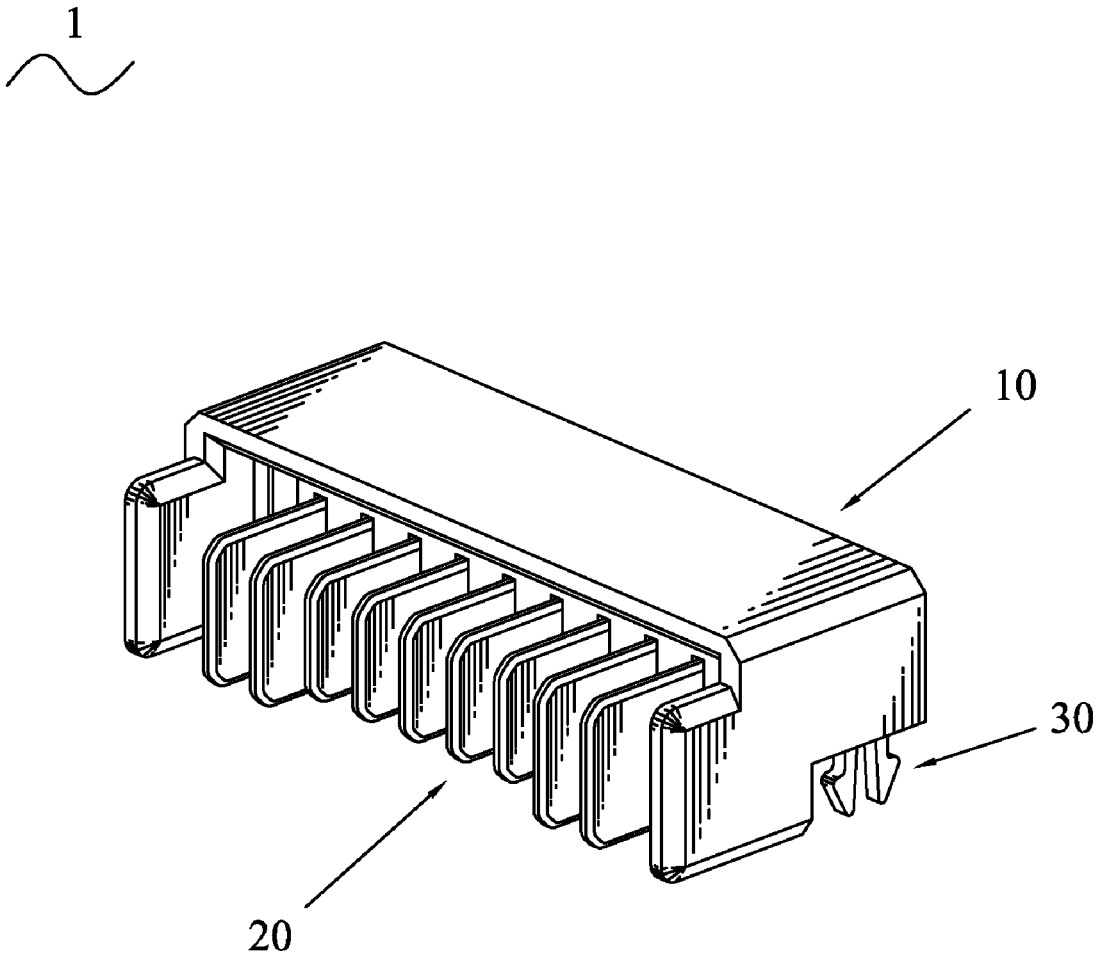
FIG. 1 is an assembled, perspective view of a battery connector of an embodiment in accordance with the present invention.
Figure 2:
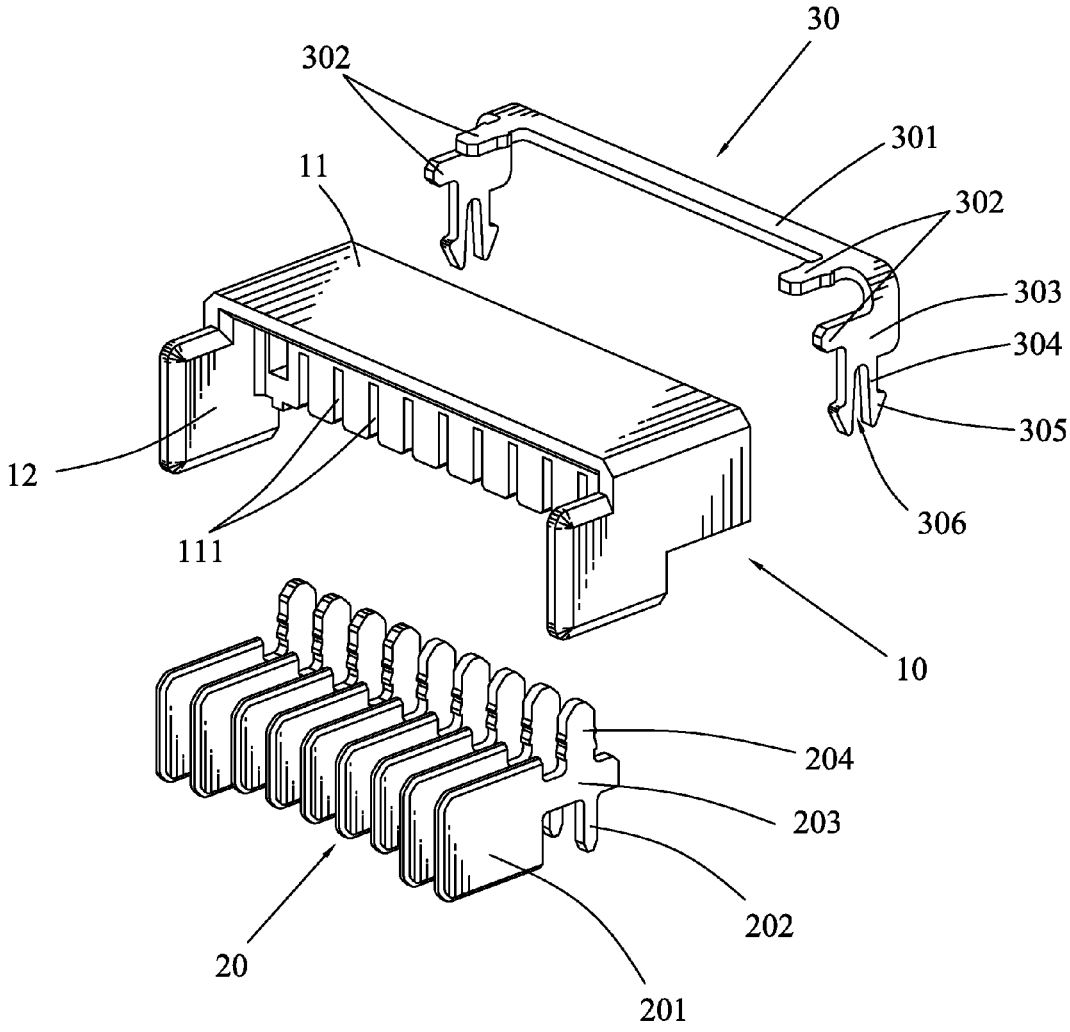
FIG. 2 is an exploded, perspective view of the battery connector shown in FIG. 1.

Referring to the drawings in greater detail, and first to FIGS. 1-2, the embodiment of the invention is embodied in a battery connector 1. The battery connector 1 comprises an insulating housing 10, a plurality of terminals 20 mounted into the insulating housing 10, and a supporting member 30 for fixing the insulating housing 10 on a printed circuit board (PCB, not shown).

Figure 3:
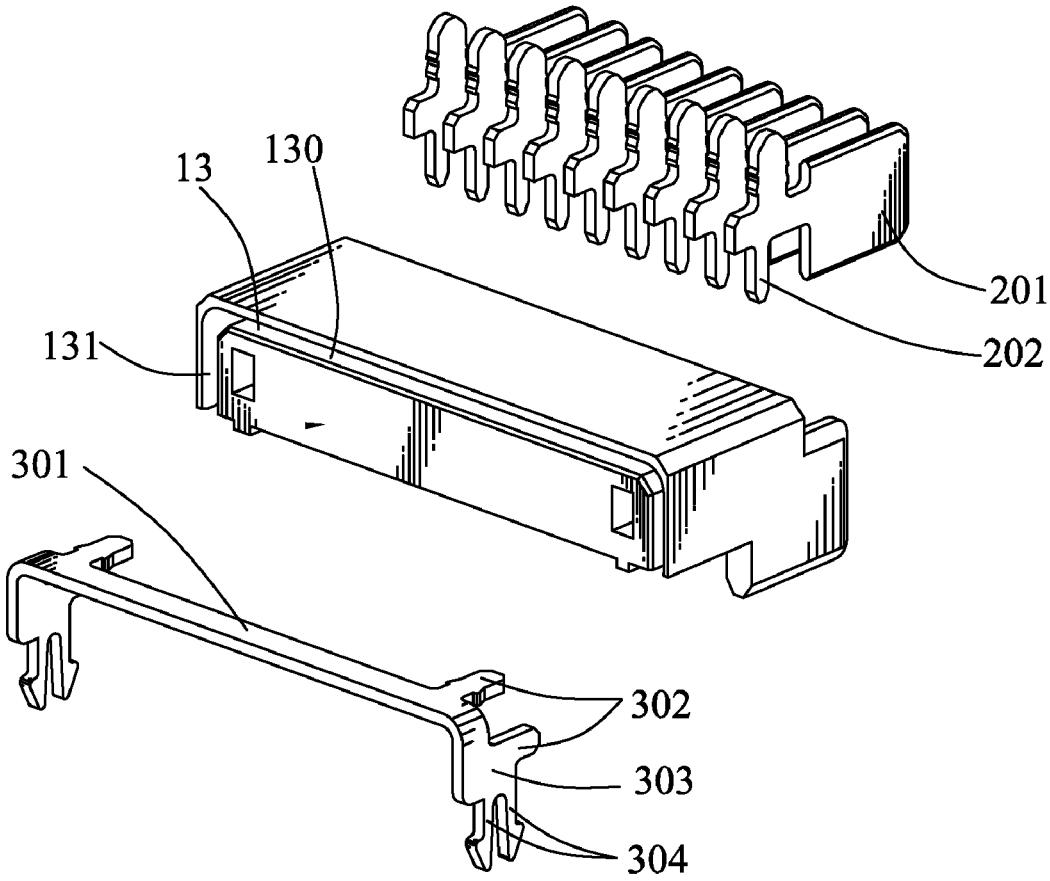
FIG. 3 is an exploded, perspective view of the battery connector shown in FIG. 2 seen from another angle.
Figure 4:
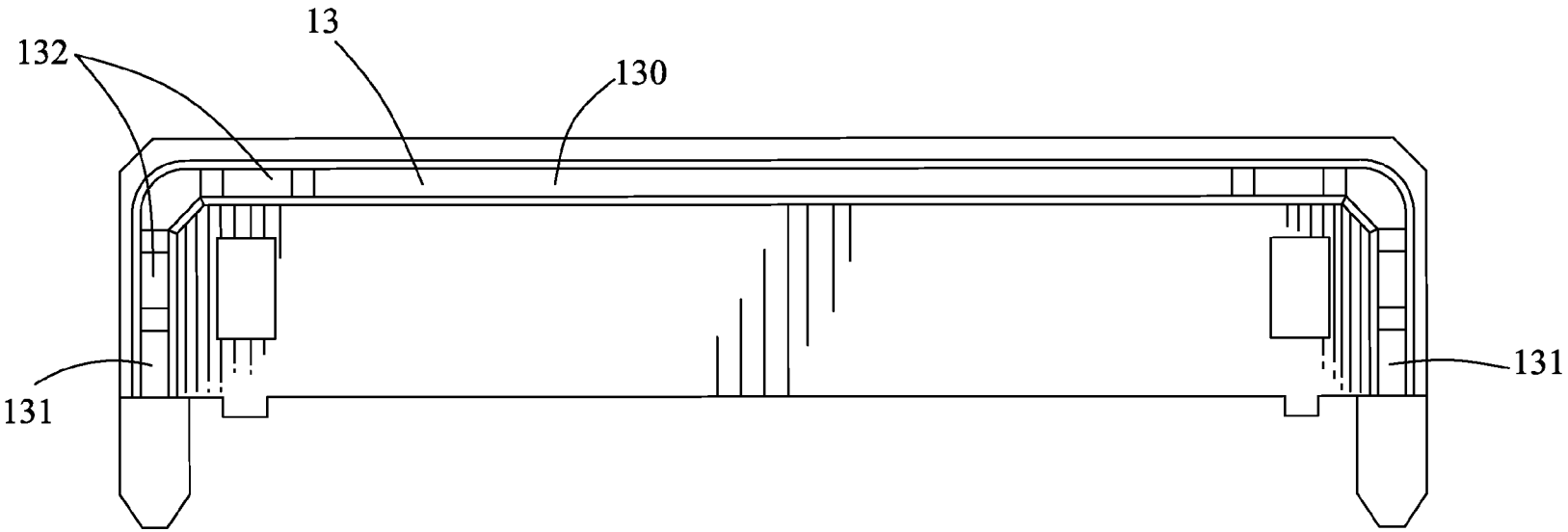
FIG. 4 is a plan view of an insulating housing of the battery connector shown in FIG. 1.
Figure 5:
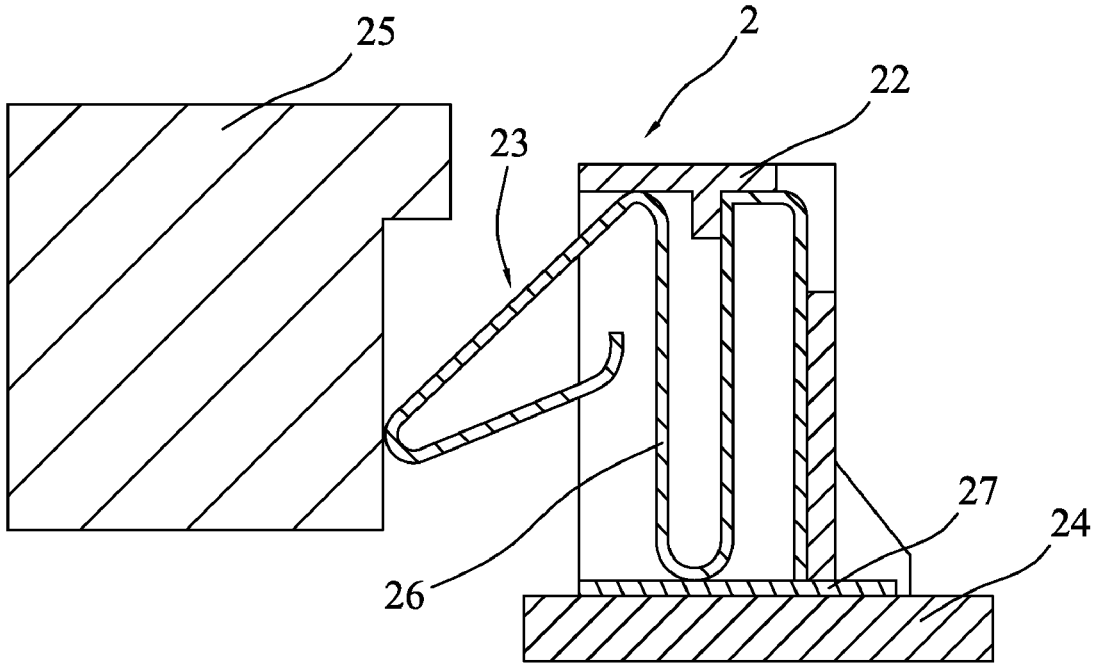
FIG. 5 (Prior Art)
FIG. 5 is a cross-sectional view of a conventional battery connector.

With reference to FIGS. 2-4, the insulating housing 10 has a rectangular base 11. A bottom of the base 11 is recessed to form a plurality of terminal grooves 111 extending along a front-to-rear direction and passing through the base 11. A front portion of a lateral side of the base 11 extends frontward and downwards to form a fixing plate 12. The fixing plate 12 is inserted into the PCB for preventing the battery connector 1 from moving levelly. A rear of the base 11 is recessed to form a recess 13 having a first recess 130 and two second recesses 131 extended downwards from two opposite ends of the first recess 130, to show an inverted-U shape. The first recess 130 extends horizontally and is adjacent to a top surface of the base 11. The second recesses 131 are respectively adjacent to two opposite lateral sides of the base 11. A plurality of fixing grooves 132 is formed at bottoms of the first recess 130 and the second recesses 131. In this embodiment, the first recess 130 has a pair of fixing grooves 132 disposed at two ends of the bottom thereof, and each of the second recesses 131 has one fixing groove 132 disposed at the bottom thereof, for fixing the supporting member 30 into the insulating housing 10.

Referring to FIG. 2, the terminal 20 received in the insulating housing 10 has a rectangular contacting plate 201 placed vertically. The contacting plate 201 has an upper portion received in the terminal groove 111 and a lower portion inserted into the PCB for transmitting signals. A rear portion of the contacting plate 201 extends rearward to form a positioning plate 203 showing a strip shape. A bottom portion of the positioning plate 203 extends downward to form a soldering plate 202 for fixing the terminals 20 on the PCB. A top side of the positioning plate 203 extends upwards to form a fixing plate 204. The fixing plate 204 is inserted into the terminal groove 111 for fixing the terminal 20 into the base 11.

Referring to FIGS. 2-3, the supporting member 30 of substantially inverted-U shape has a horizontal beam 301, and two connecting slices 303 bent downwards from two opposite ends of the horizontal beam 301. A pair of inserting slices 302 is extended frontward from a side of two opposite ends of the horizontal beam 301. A front portion of each connecting slice 303 is also extended frontward to form an inserting slice 302 fixed into the corresponding fixing groove 132 for fixing the supporting member 30 into the insulating housing 10. A bottom side of each connecting slice 303 extends downward to form a pair of fixing slices 304 inserted into the PCB in assembly. The fixing slices 304 extend downwardly and separatively, with a gap 306 formed therebetween for resiliently buckling with the PCB. Free ends of the two fixing slices 304 protrude opposite to each other to form protrusions 305.

In assembly, the terminals 20 are inserted into the terminal grooves 111. The supporting member 30 is fixed into the recess 13 with the horizontal beam 301 accommodated in the first recess 130 and the connecting slices 303 accommodated in the second recesses 131. Meanwhile, the inserting slice 302 is inserted into the corresponding fixing groove 132 for fixing the supporting member 30 into the insulating housing 10 firmly. The fixing slices 304 are inserted into the PCB with the protrusions 305 hooking the PCB for fixing the battery connector 1 on the PCB firmly.

As described above, the supporting member 30 is of substantially inverted-U shape. The horizontal beam 301 and the connecting slices 303 are respectively accommodated in the first recess 130 and the second recesses 131, and the inserting slices 302 are inserted into the fixing grooves 132 for fixing the supporting member 30 into the insulating housing 10. The fixing slice 304 is inserted into the PCB for fixing the battery connector 1 on the PCB. Therefore, the supporting member 30 wrapping the insulating housing 10 is capable of fixing the battery connector 1 on the PCB firmly.

What is claimed is:

1. A battery connector fixed on a printed circuit board (PCB), comprising:

an insulating housing having a rectangular base, a lateral side of the base extended downwards to form a fixing plate inserted into the PCB for preventing the battery connector from moving levelly with respect to the PCB, a recess formed at a rear of the base having a horizontal first recess and a pair of second recesses extended downward from two opposite ends of the first recess;

a plurality of terminals mounted into the insulating housing; and a supporting member received in the recess of the insulating housing having a horizontal beam accommodated in the first recess, a pair of connecting slices extended downwards from two opposite ends of the horizontal beam and accommodated in the corresponding second recesses, a pair of fixing slices extended downwards from a bottom of the connecting slice, free ends of the fixing slices protruded opposite to each other to form protrusions inserted into the PCB for preventing the battery connector from moving upward with respect to the PCB; wherein a pair of inserting slices is extended frontward from a side of the two opposite ends of the horizontal beam, fixed into corresponding fixing grooves disposed at two ends of a bottom of the first recess, a front of each connecting slice is also extended frontward to form an inserting slice, fixed into a fixing groove disposed at a bottom of each second recess, for fixing the supporting member into the base.

2. The battery connector as claimed in claim 1, wherein a plurality of terminal grooves is formed at a bottom of the base along a front-to-rear direction for accommodating the terminals.

3. The battery connector as claimed in claim 1, wherein the fixing slices extend downwardly and separatively, with a gap formed therebetween for resiliently buckling with the PCB.

4. The battery connector as claimed in claim 1, wherein the terminal has a rectangular contacting plate placed vertically, a rear portion of the contacting plate extends rearward to form a positioning plate showing a strip shape, a bottom portion of the positioning plate extends downward to form a soldering plate for fixing the terminal on the PCB, a top portion of the positioning plate extends upward to form a fixing plate inserted into the terminal groove for fixing the terminal into the base.

* * * * *